US008959709B2

(12) United States Patent
Hasegawa et al.

(10) Patent No.: US 8,959,709 B2
(45) Date of Patent: Feb. 24, 2015

(54) DOOR OPENING AND CLOSING DEVICE

(75) Inventors: Manabu Hasegawa, Tokyo (JP); Masaya Suzuki, Tokyo (JP)

(73) Assignee: Sugatsune Kogyo Co., Ltd., Tokyo (JP)

( * ) Notice: Subject to any disclaimer, the term of this patent is extended or adjusted under 35 U.S.C. 154(b) by 149 days.

(21) Appl. No.: 13/641,157

(22) PCT Filed: Feb. 28, 2011

(86) PCT No.: PCT/JP2011/054453
§ 371 (c)(1),
(2), (4) Date: Oct. 15, 2012

(87) PCT Pub. No.: WO2011/129154
PCT Pub. Date: Oct. 20, 2011

(65) Prior Publication Data

US 2013/0031746 A1 Feb. 7, 2013

(30) Foreign Application Priority Data

Apr. 16, 2010 (JP) ..... 2010-094715

(51) Int. Cl.
*E05F 5/02* (2006.01)
*E05D 3/14* (2006.01)
*E05F 1/12* (2006.01)
(Continued)

(52) U.S. Cl.
CPC . *E05D 3/14* (2013.01); *E05F 5/027* (2013.01); *E05F 1/1261* (2013.01); *E05F 5/00* (2013.01); *E05F 5/10* (2013.01); *E05Y 2201/26* (2013.01);
(Continued)

(58) Field of Classification Search
USPC ..... 16/50, 49, 63, 65, 366, 368, 369, 370, 16/371, 277, 278, 279, 286, 287, 288, 289, 16/291, 292, 293, 294, 296; 312/325, 327, 312/328, 116, 139, 138.1, 319.2, 319.3
See application file for complete search history.

(56) References Cited

U.S. PATENT DOCUMENTS 3,555,591 A * 1/1971 Sogoian ..... 16/49
3,765,053 A * 10/1973 Anweiler ..... 16/49
(Continued)

FOREIGN PATENT DOCUMENTS

CN 2898404 5/2007
JP 54-67123 5/1979
(Continued)

OTHER PUBLICATIONS

International Search Report, PCT/JP2011/054453, Apr. 19, 2011.
(Continued)

*Primary Examiner* — Jeffrey O Brien
(74) *Attorney, Agent, or Firm* — Young & Thompson

(57) ABSTRACT

A door opening and closing device can change a damping force of a damper when an arm rotates by opening and closing of a door. On a case 11 of the door opening and closing device 7, the arm 8 is mounted which rotates by opening and closing of the door 2. Inside the case 11, friction generating unit 22 is provided. The friction generating unit 22 has a slider 12*d* which moves linearly relative to the case 11 by opening and closing of the door 2 and a fixed part 21 which is fixed to the case 11 to slide the slider 12*d*. The friction generating unit 22 generates friction between the slider 12*d* and the fixed part 21. In opening and closing of the door 2, a radio of the rotation angle of the arm 8 and the amount of displacement of the slider 12*d* is varied.

8 Claims, 14 Drawing Sheets

(51) Int. Cl.
*E05F 5/00* (2006.01)
*E05F 5/10* (2006.01)

(52) U.S. Cl.
CPC ..... *E05Y 2201/264* (2013.01); *E05Y 2900/20* (2013.01)
USPC ..... 16/65; 16/50

(56) References Cited

U.S. PATENT DOCUMENTS

| | | | | |
|---|---|---|---|---|
| 4,190,274 | A * | 2/1980 | Gross et al. | 292/338 |
| 5,904,411 | A * | 5/1999 | Hayakawa | 312/319.2 |
| 7,178,202 | B2 * | 2/2007 | Hirtsiefer et al. | 16/366 |
| 7,240,974 | B2 * | 7/2007 | Hirtsiefer | 312/109 |
| 7,478,891 | B2 | 1/2009 | Hollenstein | |
| 7,500,287 | B2 * | 3/2009 | Brustle | 16/286 |
| 7,562,757 | B2 | 7/2009 | Dubach et al. | |
| 7,707,687 | B2 * | 5/2010 | Giovannetti | 16/289 |
| 7,797,796 | B2 * | 9/2010 | Migli | 16/366 |
| 7,798,541 | B2 * | 9/2010 | Hirtsiefer | 292/262 |
| 7,810,213 | B2 * | 10/2010 | Brustle | 16/286 |
| 8,082,629 | B2 * | 12/2011 | Migli | 16/366 |
| 8,321,996 | B2 * | 12/2012 | Hirtsiefer | 16/286 |
| 2004/0239213 | A1 * | 12/2004 | Hirtsiefer | 312/109 |
| 2006/0032019 | A1 * | 2/2006 | Kistner et al. | 16/286 |
| 2006/0284530 | A1 | 12/2006 | Hollenstein | |
| 2008/0121490 | A1 | 5/2008 | Dubach et al. | |
| 2008/0172833 | A1 * | 7/2008 | Migli | 16/277 |
| 2008/0216289 | A1 * | 9/2008 | Salice | 16/366 |
| 2008/0238276 | A1 * | 10/2008 | Migli | 312/326 |
| 2009/0064457 | A1 * | 3/2009 | Brustle | 16/292 |
| 2010/0148646 | A1 * | 6/2010 | Bettinzoli | 312/326 |
| 2012/0084944 | A1 * | 4/2012 | Hirtsiefer | 16/302 |

FOREIGN PATENT DOCUMENTS

| | | |
|---|---|---|
| JP | 62-54197 | 4/1987 |
| JP | 3300981 | 7/2002 |
| JP | 2007-522363 | 8/2007 |
| JP | 2008-525673 | 7/2008 |

OTHER PUBLICATIONS

Chinese Office Action dated Apr. 11, 2014 in corresponding Chinese Patent Application No. 201180011402.6.

* cited by examiner 12d
21
17
19
12
8
0°

17
12
19
8
10°

12
26
17
19
8
20°

14
12
26
17
8a
8
30°

40°

50°

60°

12
17
70°

DOOR OPENING AND CLOSING DEVICE

TECHNICAL FIELD

The present invention relates to a door opening and closing device, provided between a door and a door mounting member such as a cabinet, for enabling smooth opening and closing operations of the door.

BACKGROUND ART

The door opening and closing device mounted on the door has the function of enabling the manual opening operation of the door easily and by a small force with use of a biasing force of a compression spring and the function of slowing the opening and closing operations of the door by a damping force of a damper (see PL1).

Such a door opening and closing device has an arm which rotates by opening and closing operations of the door and a runner that is biased by a compression spring to give a biasing force in the opening or closing direction to the arm. The arm and the runner are connected to each other by a link arm which synchronizes rotation of the arm with linear movement of the runner. An end of the link arm is rotatably connected to the runner and the other end of the link arm is rotatably connected to the periphery of the rotation center of the arm. With use of an elastic force of the compression spring, the opening and closing operations of the door can be performed easily by a small force.

The door opening and closing device is provided with a damper for slowing the opening and closing operations of the door. As the damper is used to brake the opening or closing operation of the door based on the elastic force of the compression spring, the door can open and close slowly.

The patent literature 1 (PL1) discloses a door opening and closing device in which a rotary damper is used as the above-mentioned damper and is mounted on the rotation axis of the arm. A one-way clutch may be built in the rotary damper thereby to generate a damping force only in opening or closing of the door.

The patent literature 2 (PL2) discloses an example of using a linear damper. There is provided a neutral range between the opening position and the closing position of the arm, in which range the damping force of the damper is not available. The damping force is set to be generated just before the opening position and closing position of the arm.

CITATION LIST

Patent Literature

PL1: Japanese Patent No. 3300981

PL2: Japanese Patent Application Laid-Open No. 2007-522363

SUMMARY OF INVENTION

Technical Problem

However, in the door opening and closing device disclosed in the patent literature 1, the rotary damper generates a fixed damping force while the arm rotates from the closing position to the opening position. Therefore, for example, it is difficult to reduce the damping force when the arm is near the closing position and to increase the damping force when the arm is near the opening position. In order to facilitate the opening direction of the door, it is requested to reduce the damping force when the arm is near the closing position.

In the door opening and closing device disclosed in the patent literature 2, the neutral range where the damping force of the damper is not available is provided between the opening position and the closing position of the arm. However, once the damping force is generated, its size or magnitude does not change. Therefore, it is difficult to vary or adjust the damping force in accordance with the degree of opening and closing of the arm.

Then, the present invention aims to provide a door opening and closing device capable of changing a damping force of the damper when the arm rotates by opening and closing of the door.

Solution to Problem

In order to solve the above-mentioned problems, a first aspect of the present invention is a door opening and closing device comprising: a case mounted on a door mounting member; an arm which is provided rotatable on the case and rotates by opening and closing of a door; biasing means for applying at least one of a biasing force in an opening direction and a biasing force in a closing direction to the arm; and friction generating means having a slider which moves linearly relative to the case by opening and closing of the door and a fixed part which is fixed to the case to slide the sider, the friction generating means being provide for generating friction between the slider and the fixed part.

Advantageous Effects of Invention

According to the present invention, the friction generating means for generating friction between the slider and the fixed part is used to change a ratio of the rotation angle of the arm and the amount of displacement of the slider. With this structure, it is possible to change the damping force of the friction generating means when the arm rotates by opening and closing of the door. Therefore, it is possible to obtain an appropriate damping force in accordance with the degree of opening and closing of the door.

BRIEF DESCRIPTION OF DRAWINGS

The above and other objects and features of the invention will appear more fully hereinafter from a consideration of the following description taken in connection with the accompanying drawing wherein one example is illustrated by way of example, in which;

FIG. 8(*h*) illustrates the door open);

FIG. 13(*h*) illustrates the door open);

FIGS. 16(*a*) and 16(*b*) are cross sectional views of the door opening and closing device with the friction damper mounted on.

DESCRIPTION OF EMBODIMENTS

Figure 1:
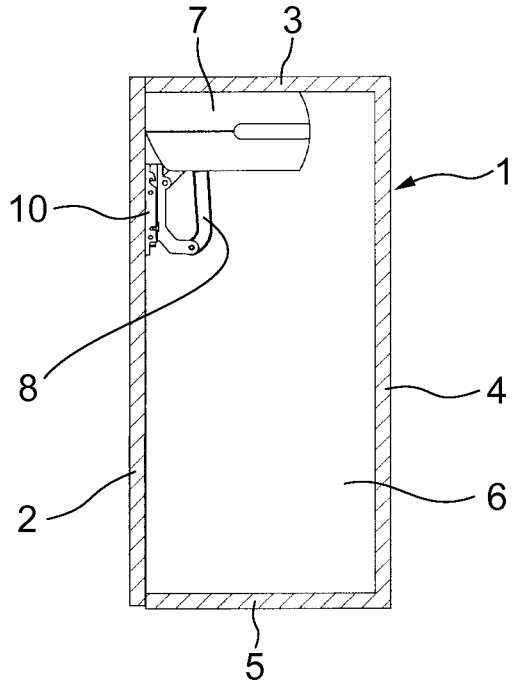
FIG. 1 is a vertical cross sectional view of a door-equipped cabinet (a door is closed)
Figure 2:
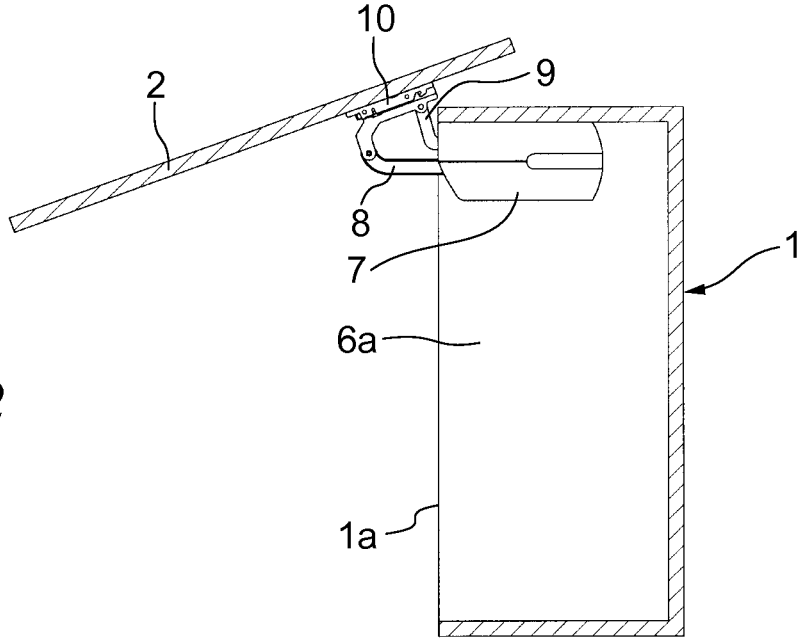
FIG. 2 is a vertical cross sectional view of the door-equipped cabinet (the door is open)

With reference to the attached drawings, description will be made about embodiments of the present invention. FIG. 1 is a vertical cross sectional view of a door-equipped cabinet on which the door opening and closing device according to the first embodiment of the present invention is mounted (a door is closed). FIG. 2 is a vertical cross sectional view of the door-equipped cabinet (the door is open).

A door mounting member 1 has a top plate 3, a back plate 4, a bottom plate 5 and a pair of side plates 6. The door opening and closing device 7 is fixed to a side plate inner wall 6*a* of the door mounting member 1. On the door opening and closing device 7, a door 2 such as a trap door is mounted via a connecting part 10 mounted on an arm 8 and an auxiliary arm 9. When the arm 8 and the auxiliary arm 9 rotate, the door 2 opens or closes vertically so that an opening part la of the door mounting member 1 is closed or opened. The typical door 2 is connected to the door mounting member 1 via a hinge which makes the door 2 rotatable, however, if the door opening and closing device 7 is provided, the hinge is not required.

Figure 3:
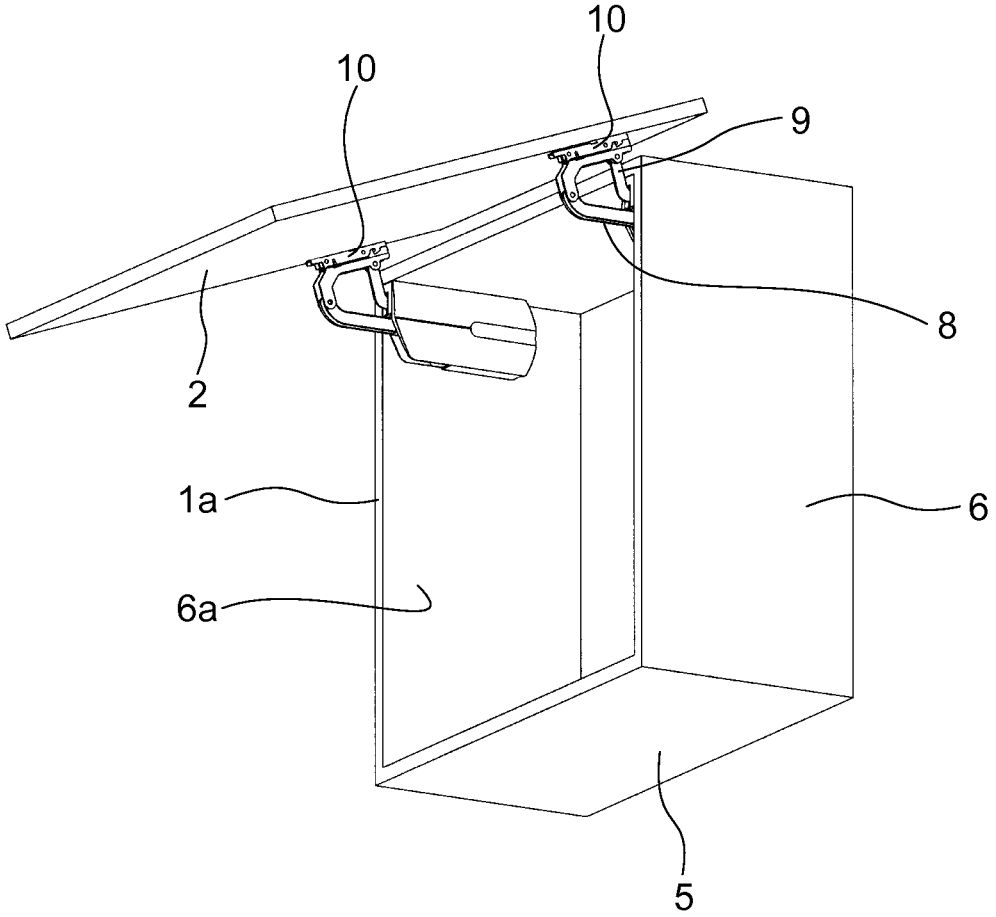
FIG. 3 is a perspective view of the door-equipped cabinet (the door is open)

FIG. 3 is a perspective view of the door-equipped cabinet (the door is open). The door opening and closing devices 7 in a pair are fixed to the side plate inner wall 6*a* on the respective side of the door mounting member 1 and also mounted on the door 2 via the two connecting parts 10. Therefore, the door 2 is prevented from being twisted relative to the door mounting member 1 and stable opening and closing operation is allowed.

Figure 4:
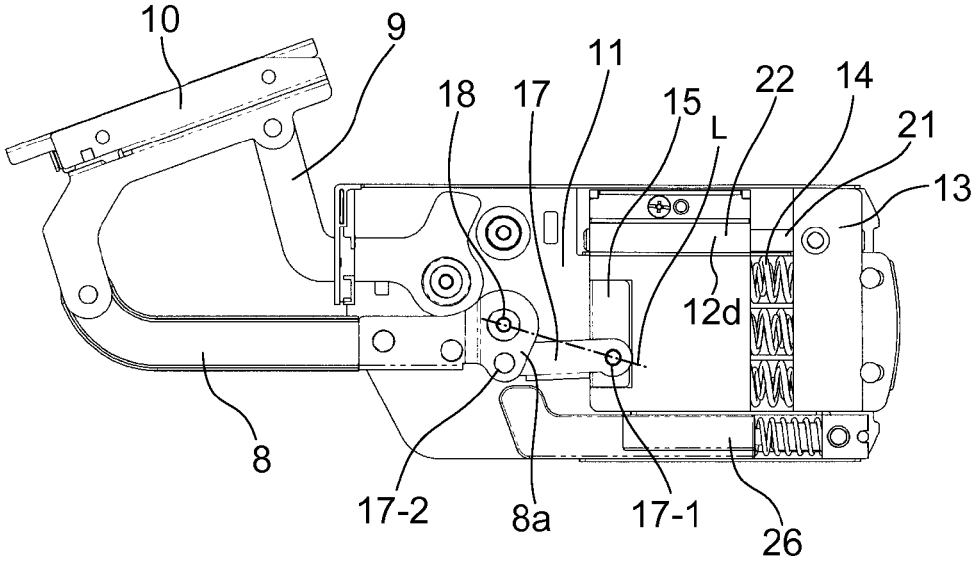
FIG. 4 is an assembly view of a door opening and closing device according to a first embodiment of the present invention (the door is open)
Figure 5:
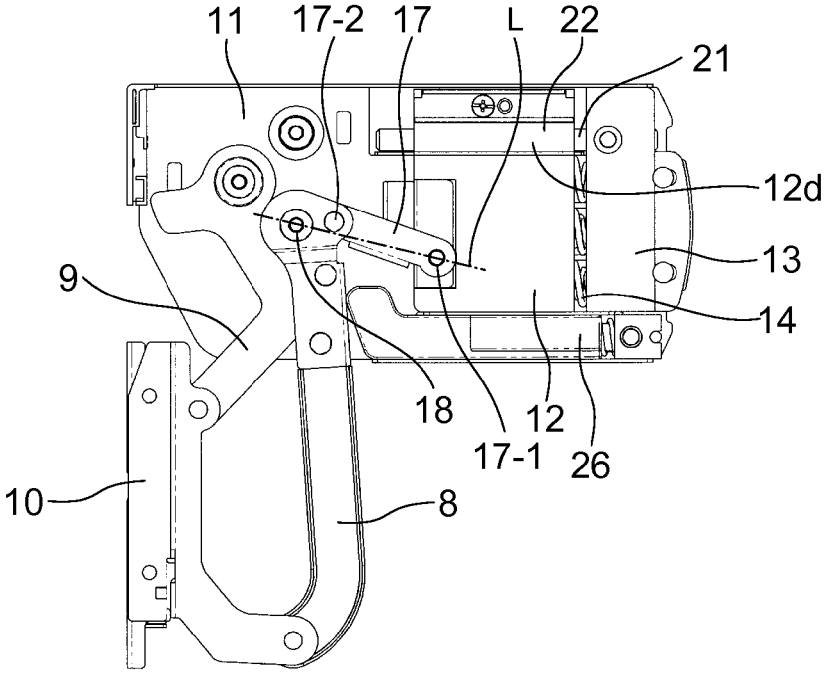
FIG. 5 is an assembly view of the door opening and closing device (the door is closed)

FIG. 4 illustrates the door opening and closing device 7 according to the first embodiment of the present invention (the door is open) and FIG. 5 illustrates the door opening and closing device 7 (the door is closed). On the side plate inner wall 6*a* of the door mounting member 1, a case 11 is mounted. The arm 8 and the auxiliary arm 9 are connected to the case 11 rotatably. The connecting part 10 is connected to the arm 8 and the auxiliary arm 9 rotatably. These case 11, arm 8, auxiliary arm 9 and connecting part 10 form a four-link mechanism.

When the door 2 is opened or closed manually, the arm 8 and the auxiliary arm 9 rotate from the closed-a position of FIG. 5 to the open position of FIG. 4. A runner 12 is linearly movable relative to the case 11 in the left and right directions of FIG. 4. The runner 12 is connected to an end of a link arm 17 rotatably. The other end of the link arm 17 is connected to the arm 8 rotatably around an arm axis 18 which is a rotation center of the arm 8. The link arm 17 converts rotational movement of the arm 8 into linear movement of the runner 12.

The line connecting the rotation center 17-1 of the link arm 17 relative to the runner 12 to the arm axis 18 is a change line L. As illustrated in FIG. 5, when the door 2 is closed, the rotation center 17-2 of the link arm 17 relative to the arm 8 is positioned above the change line L and the runner 12 gives the arm 8 a biasing force in the closing direction so as to maintain the door 2 closed. When the door 2 is rotated in the opening direction manually, the rotation center 17-2 of the link arm 17 moves below the change line L. Then, the runner 12 gives the arm 8 a biasing force in the opening direction. As illustrated in FIG. 4, when the door 2 is opened, the runner 12 gives the biasing force in the opening direction to the arm 8. With this structure, the door 2 is maintained in the open state.

Above the runner 12, a friction damper 22 is provided as friction generating means for attenuating the impact when the door 2 gets open. The friction damper 22 has a block 12*d* as a slider and a friction bar 21 as a fixed part which is fixed to the case 11. The block 12*d* has a through hole 12*c* (see FIG. 6) through which the friction bar 21 passes. When the door 2 opens or closes, the block 12*d* moves linearly relative to the case 11. When the block 12*d* moves linearly relative to the case 11, the block 12*d* slides the friction bar 21 thereby to generate friction between the block 12*d* and the friction bar 21.

Below the runner 12, a linear damper 26 is provided for attenuating the impact when the door 2 gets closed. The linear damper 26 may be a publicly known linear damper having a cylinder filled with viscous fluid and an extendable rod.

Figure 6:
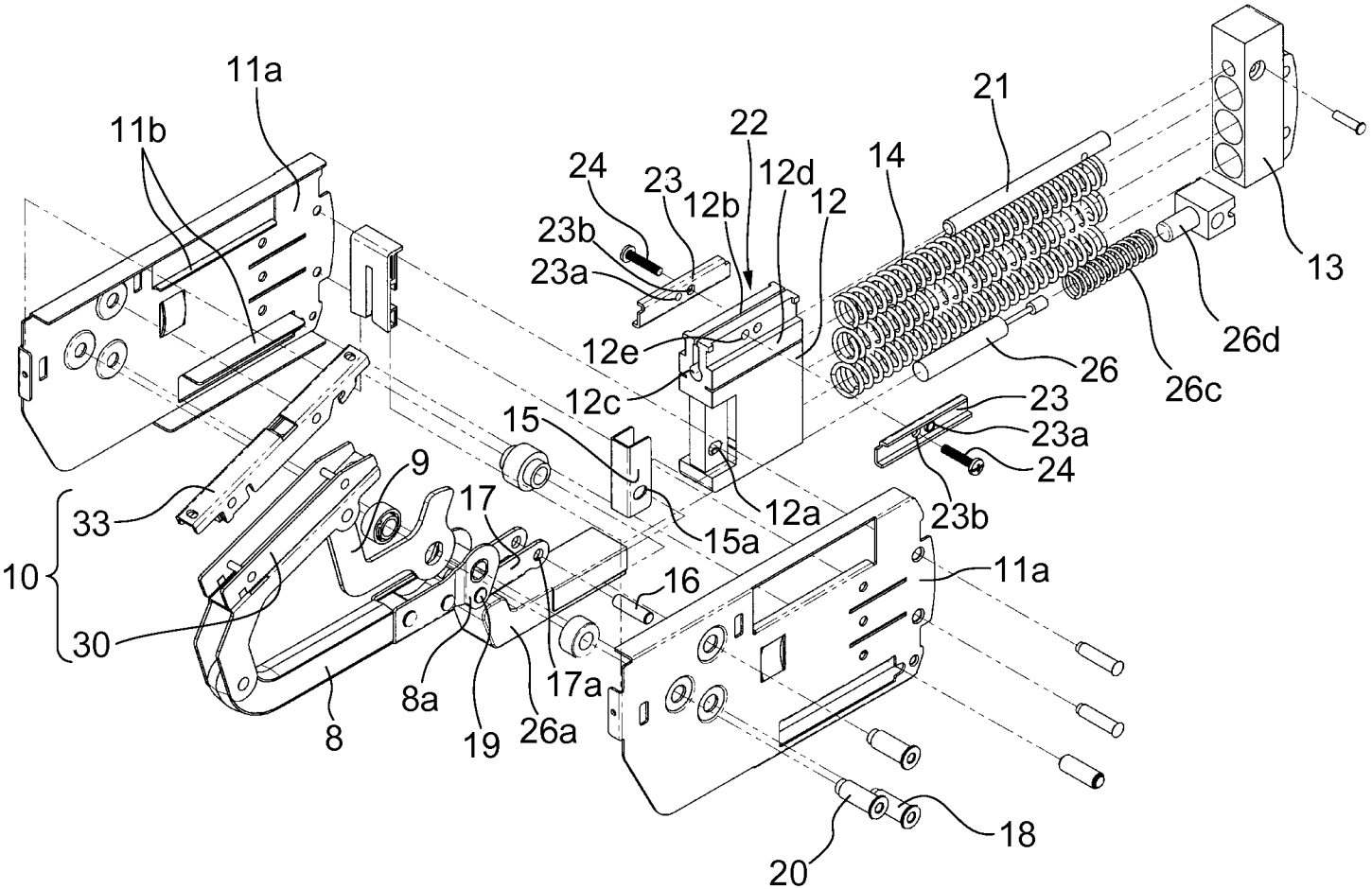
FIG. 6 is an exploded perspective view of the door opening and closing device.

FIG. 6 is an exploded perspective view of the door opening and closing device 7. The case 11 is divided into right and left split cases 11*a*. In the case 11, the runner 12 is housed linearly movable. In the case 11, a guide wall 11*b* is formed for guiding linear movement of the runner 12. At the right end of the case 11 in FIG. 6, a stopper 13 is fixed, and at least one (three in FIG. 6) compression spring 14 is provided as biasing member. The compression spring 14 is provided between the runner 12 and the stopper 13. The runner 12 is biased to the left in FIG. 6 by the compression spring 4.

At the left end of the runner 12, a reinforcement plate 15 is provided. The runner 12 and the reinforcement plate 15 have axis pin holes 12*a* and 15*a* formed therethrough, respectively. In the axis pin holes 12*a* and 15*a*, an axis pin 16 passes through. The axis pin 16 also passes through the axis pin hole 17*a* at one end of the link arm 17 so that the link arm 17 is rotatable relative to the runner 12.

In the case 11, the arm axis 18 (see FIG. 4) is fixed to the left side of the runner 12. A rotation base 8*a* of the arm 8 is made rotatable by the arm axis 18. A pivot pin 19 passes through around the arm axis 18 at the rotation base 8*a* of the arm 8 and the link arm 17 is connected to the pivot pin 19 rotatably.

The arm 8 is formed jutting from the rotation base 8*a* and the connecting part 10 to connect to the door 2 is provided at the tip end of the arm 8. In the case 11, an auxiliary arm axis 20 is fixed near the arm axis 18 and the auxiliary arm axis 20 is connected rotatably to the auxiliary arm 9. At the tip end of the auxiliary arm 9, the connecting part 10 to connect to the door 2 is provided. The connecting part 10 is connected rotatably to the arm 8 and the auxiliary arm 9.

On the runner 12, the block 12*d* is provided integrally. The runner 12 and the block 12*d* may be formed integral with each other by resin molding or connected by a fastening member like a screw. In the block 12*d*, a through hole 12*c* is formed extending in the moving direction of the runner 12. In the block 12*d*, a slit 12*b* is formed extending in parallel with the through hole 12*c* and communicating to the through hole 12*c*. In the through hole 12*c*, the friction bar 21 in parallel with the moving direction of the runner 12 passes therethrough and an end of the friction bar 21 is fixed to the stopper 13.

Next description is made about the adjustment method of the friction force of the friction damper 22. At both, right and left, ends of the block 12*d*, respective friction plates 23 are provided in a pair. Each friction plate 23 has one adjustment screw hole 23*a* and one adjustment through hole 23*b* formed therein. An adjustment bolt 24 is made to pass from each side of the slit 12*b* through the adjustment through hole 23*b* of the friction plate 23 and the adjustment hole 12*e* of the block 12*d* and is tightened in the adjustment screw hole 23*a* of the opposite friction plate 23. By the tightening force of the adjustment bolt 24, the block 12*d* is easily deformed elastically thereby to change the width of the slit 12*b*. This changes the size of the through hole 12*c*, thereby adjusting the tightening force between the friction bar 21 and the through hole 12*c*.

Figure 7B:
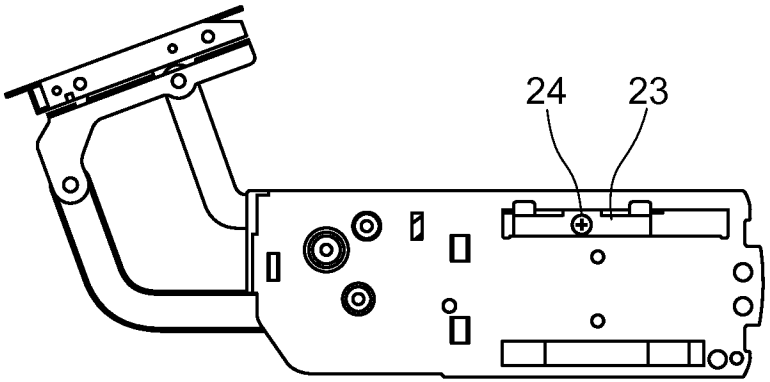
FIGS. 7(*a*) to 7(*c*) are views illustrating the door opening and closing device with or without a cover (FIG. 7(*a*) is a front view of the door opening and closing device with the cover, FIG. 7(*b*) is a front view of the door opening and closing device without cover and FIG. 7(*c*) is a back view of the door opening and closing device without cover)
Figure 7A:
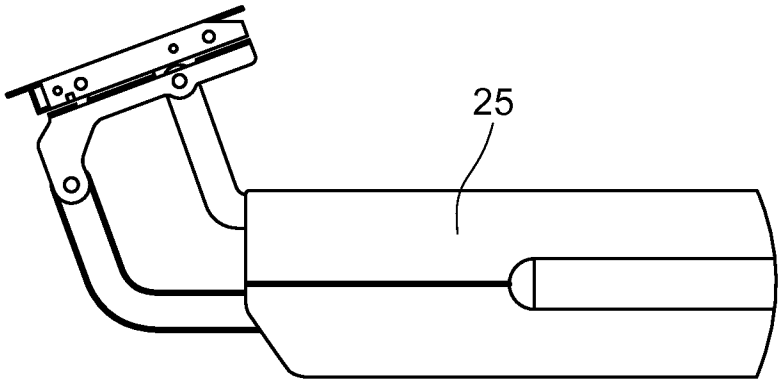
Figure 7C:
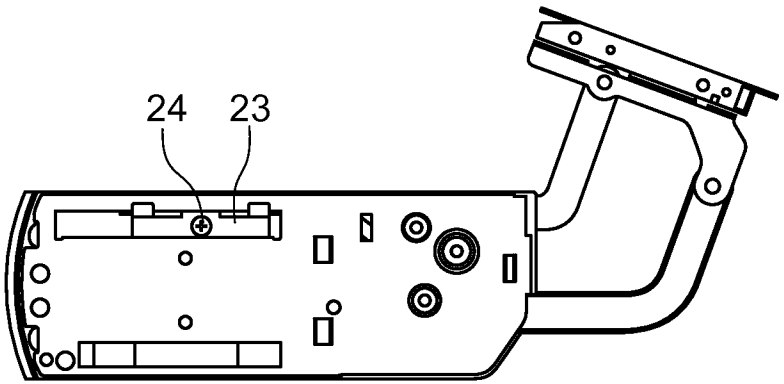

FIG. 7(*a*) is a front view of the door opening and closing device 7 with a cover 25, FIG. 7(*b*) is a front view of the door opening and closing device 7 from which the cover 25 is removed and FIG. 7(*c*) is a back view of the door opening and closing device 7 from which the cover 25 is removed. As the adjustment bolts 24 are tightened from the two directions, that is, the front direction of FIG. 7(*b*) and the back direction of FIG. 7(*c*), they can be tightened and loosened from both of the front side and the back side.

When the block 12*d* moves linearly, there is produced a friction force between the through hole 12*c* and the friction bar 21 thereby to brake the linear movement of the block 12*d*. As the block 12*d* of the friction damper 22 is integral with the runner 12, the friction force generated by differential motion of the friction bar 21 and the block 12*d* directly acts on the runner 12. Therefore, it is not necessary to provide a separate mechanism for moving the block 12*d* linearly and the number of components can be reduced.

As illustrated in FIG. 6, the linear damper 26 is housed in a damper body 26*a*. An end of the linear damper 26 abuts to a damper receiver 26*d* fixed to the case 11. A damper spring 26*c* is wound around the linear damper 26. The damper spring 26*c* is provided for increasing the damping force and is provided between the damper body 26*a* and the damper receiver 26*d*.

Figures 8A, 8B, 8C, 8D, 8E, 8F, 8G, 8H:
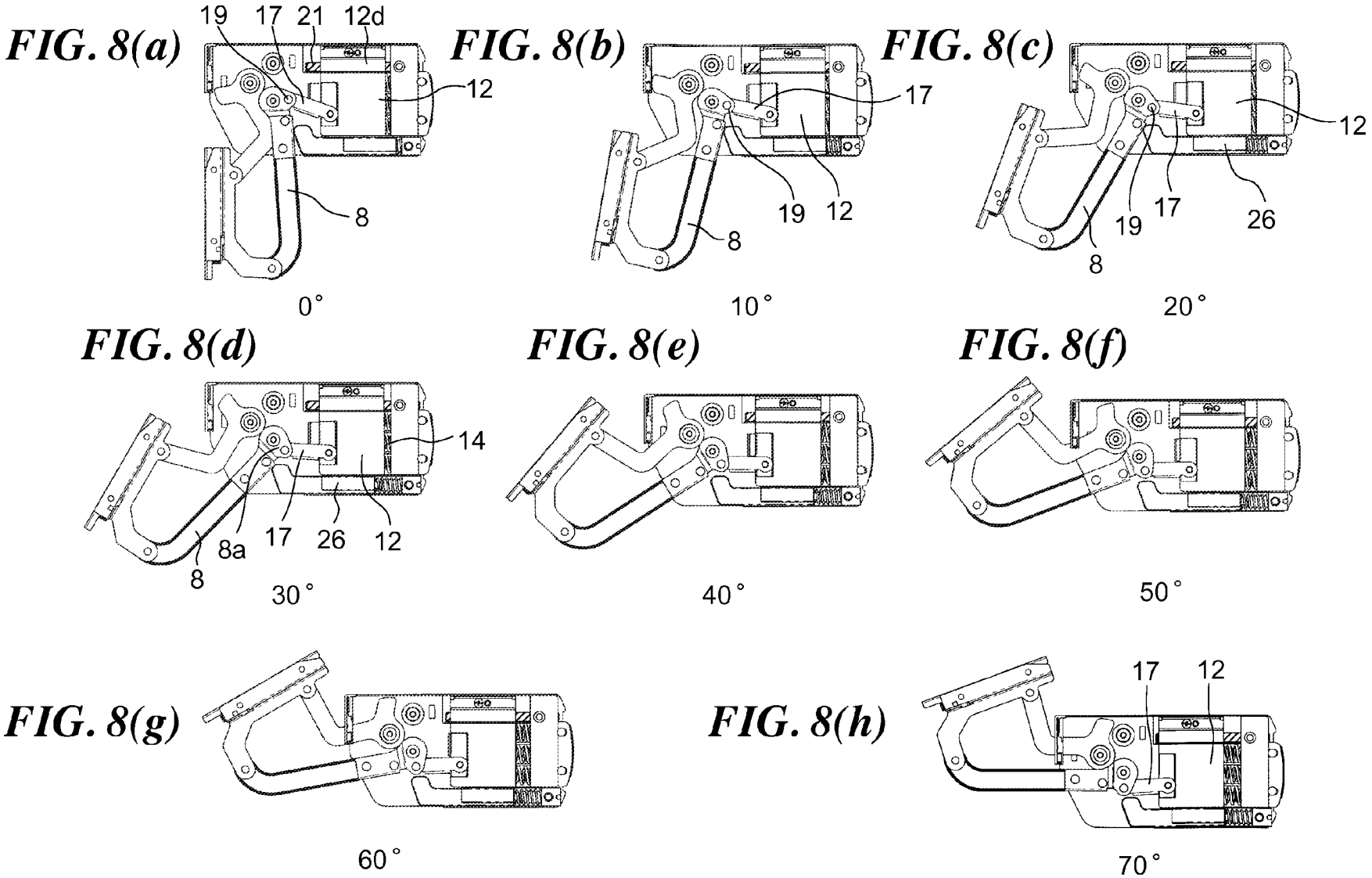
FIGS. 8(*a*) to 8(*h*) are plan views of the door opening and closing device in which the arm rotates by 10 degrees (FIG. 8(*a*) illustrates the door closed, and FIGS. 8(*b*) to 8(*h*) illustrate the arm rotating by 10 degrees.

Next description is made, with reference to FIGS. 8(*a*) to 8(*h*), about the relation between the rotational movement of the arm 8 by opening and closing of the door 2 and the linear movement of the runner 12 (block 12*d*) in synchronization with the rotational movement of the arm 8. The rotational movement of the arm 8 is converted to the linear movement of the runner 12 by the link arm 17.

FIG. 8(*a*) illustrates the door opening and closing device 7 when the door 2 is closed and the rotation angle of the arm 8 is 0 degree. FIG. 8(*b*) illustrates the door opening and closing device 7 when the arm 8 rotates 10 degrees in the opening direction, and FIGS. 8(*c*) to 8(*h*) also illustrate the door opening and closing device 7 as the arm 8 rotates by 10 degrees in the opening direction. FIG. 8(*h*) illustrates the door opening and closing device 7 when the door 2 is opened completely.

As illustrated in FIGS. 8(*a*) to 8(*c*), when the rotation angle of the arm 8 is changed from 0 to 20 degrees, the pivot pin 19 moves mainly downward and therefore, the link arm 17 is rotated by the axis pin 16 but the runner 12 almost moves linearly. Therefore, there occurs almost no differential motion of the block 12*d* relative to the friction bar 21, and it is possible to open the door 2 by a small force until the arm 8 rotates up to 20 degrees.

FIG. 8(*d*) illustrates the door opening and closing device 7 when the arm 8 rotates 30 degrees. When the rotation angle of the arm 7 exceeds 30 degrees, the force of the compression spring 14 to bias the arm 8 in the opening direction becomes increased so that the door 2 can open automatically. On the other hand, as the differential motion of the block 12*d* relative to the friction bar 21 also increases, the damping force acts on the runner 12, and thereby, it is possible to prevent quick linear movement of the runner 12.

FIG. 8(*h*) illustrates the door opening and closing device 7 when the door 2 is open. Immediately before the door 2 gets open, the force of the compression spring 14 to bias the arm 8 is further increased. However, the differential motion of the block 12*d* relative to the friction bar 21 is further increased, and the damping force from the friction bar 21 is also further increased. Therefore, the impact when the door gets open is attenuated.

In this way, as the ratio of the rotation angle of the arm 8 and the amount of displacement of the runner 12 is changed, it is possible to reduce the damping force of the friction damper 22 when the rotation angle of the arm 8 is small and to increase the damping force of the friction damper 22 when the rotation angle of the arm 8 is large. Therefore, it is possible to obtain an appropriate damping force in accordance with the degree of opening and closing of the arm 8.

Next, the closing process of the door 2 is described with reference to FIGS. 8(*a*) to 8(*h*). Opposite to the opening operation, the door 2 starts to close from the open state of FIG. 8(*h*) and the arm 8 is rotated. Then, the compression spring 14 is compressed via the runner 12 and the link arm 17. As the door 2 is flipped up at the high position, the torque which acts on the arm 8 is large due to the weight of the door 2 and the compression spring 14 can be easily compressed manually.

As illustrated in FIG. 8(*d*), when the rotation angle of the arm 8 is 30 degrees, the rotation base 8*a* of the arm 8 starts to be in contact with the damper body 26*a* provided below the runner 12. FIG. 8(*c*) illustrates the door opening and closing device 7 when the door 2 is further rotated in the closing direction. The rotation angle of the arm 8 becomes small and the damping force of the friction damper 22 is reduced. However, as the linear damper 26 operates, the closing direction of the door 2 becomes slow.

Next description is made about the structure and operation of the connecting part 10.

Figure 9:
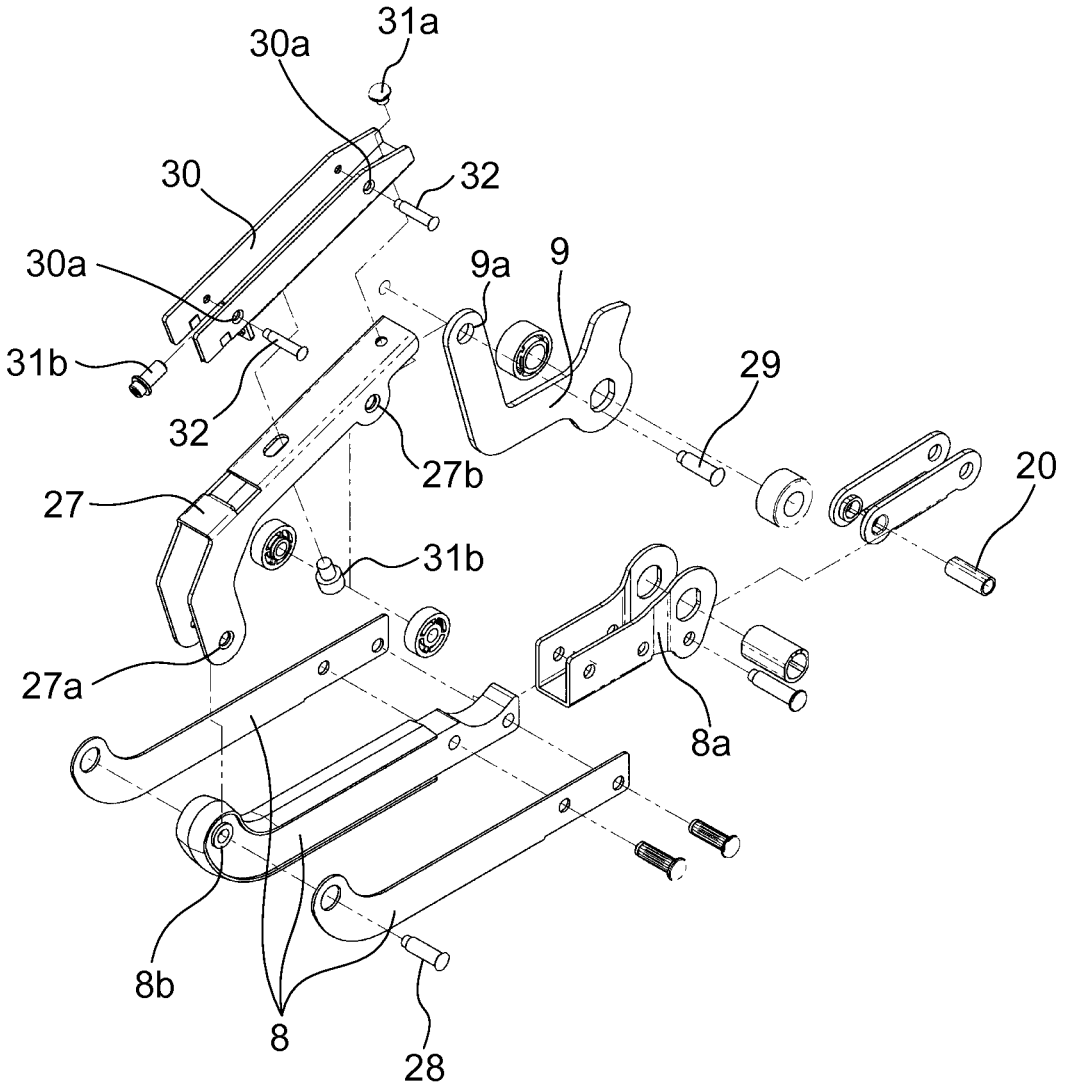
FIG. 9 is an exploded view of an arm, an auxiliary arm and a part of a connecting part (mounting member)

FIG. 9 is an exploded view of the arm 8, the auxiliary arm 9 and a part of the connecting part 10. The arm 8 has a mounting pin hole 8*b* formed at the tip end opposite to the rotation base 8*a*. The auxiliary arm 9 has an auxiliary mounting pin hole 9*a* formed at the tip end opposite to the auxiliary arm axis 20. At both ends of a mounting plate 27, mounting holes 27*a* and 27*b* are formed so that a plate mounting pin 28 and an auxiliary mounting pin 29 pass through the mounting holes 27*a* and 27*b*. The mounting plate 27 is pivoted on the tip ends of the arm 8 and auxiliary arm 9 opposite to the runner 12. The mounting plate 27 is rotatable by the plate mounting pin 28 and the auxiliary mounting pin 29. To the mounting plate 27, a mounting member 30 is fixed by fixing pins 31*a* and 31*b*. At both ends of the mounting member 30, stepped pin holes 30*a* are formed for insertion of stepped pins 32.

Figure 10:
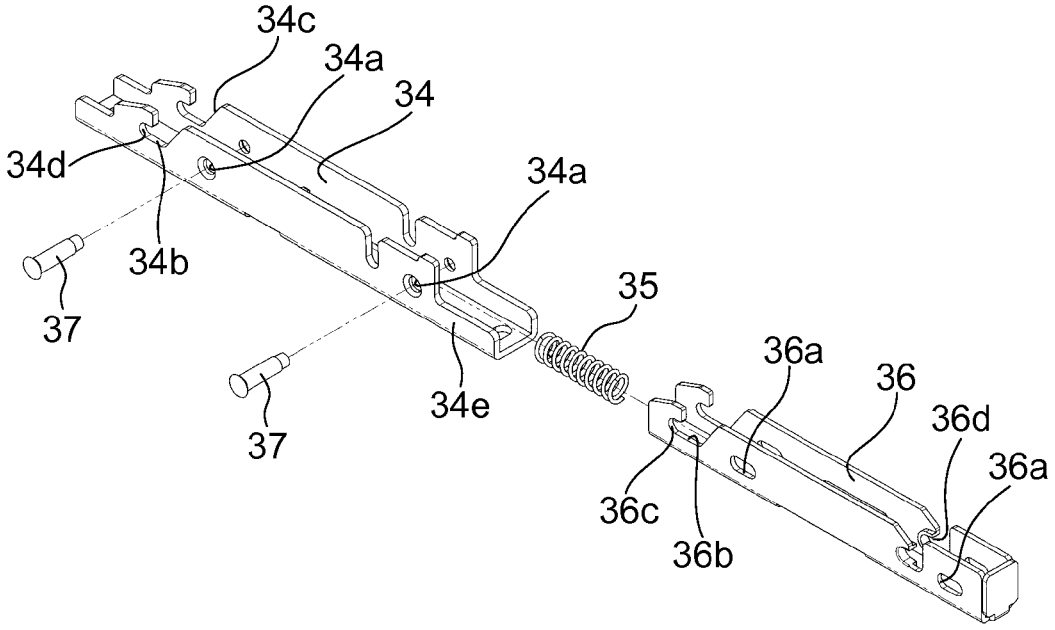
FIG. 10 is an exploded view of a door side mounting part.
Figure 11B:
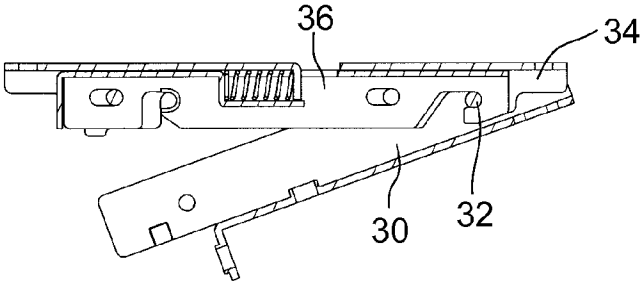
FIGS. 11(*a*) to 11(*e*) are plan views illustrating connection of the mounting member and the door side mounting part (FIG. 11(*a*) is a plan view of the mounting member and the door side mounting part which are not yet connected to each other, FIGS. 11(*b*) to 11(*e*) are plan views of the connecting process, and FIG. 11(*e*) is a plan view of the mounting member and the door side mounting part which are completely connected to each other)
Figure 11D:
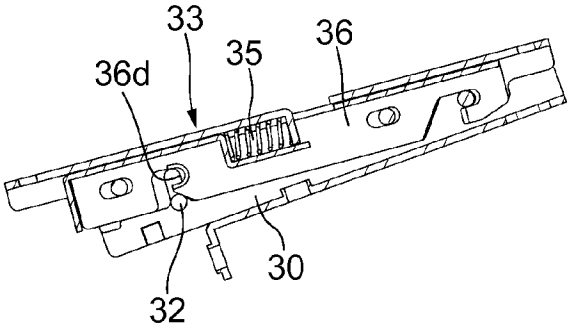
Figure 11A:
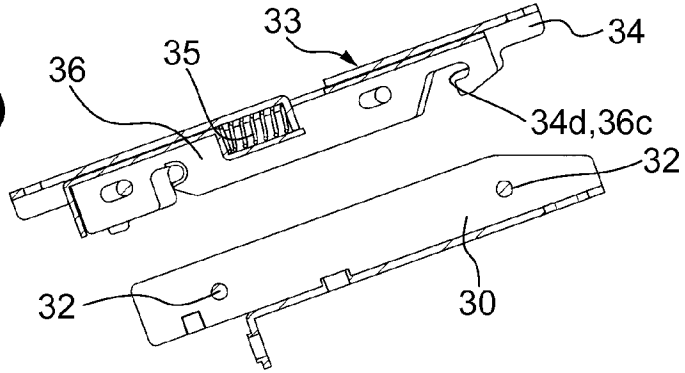
Figure 11C:
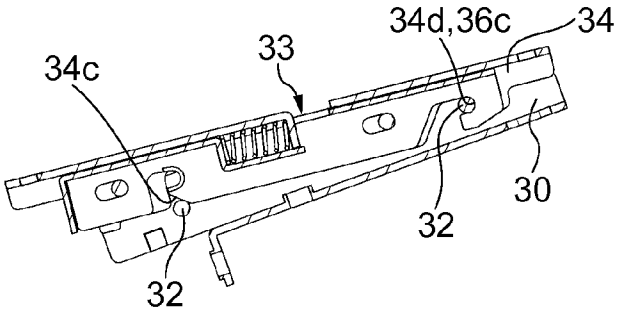
Figure 11E:
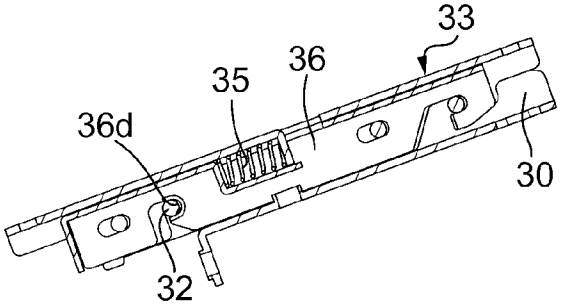

FIG. 10 is an exploded view of a door side mounting part 33. In a door plate 34, a lever 36 is inserted via a mounting spring 35, and the lever 36 is biased to the right in FIG. 10 by the mounting spring 35. The door plate 34 has two door side stepped pin holes 34*a* formed therein and the lever 36 has two lever mounting long holes 36*a* formed therein. Two door side stepped pins 37 are made to pass through the door side stepped pin holes 34*a* and the lever mounting long holes 36*a*, respectively, so that the lever 36 can slide until the door side stepped pins 37 abut to the lever mounting long holes 36*a* (see FIG. 11(*a*)). The door plate 34 and the lever 36 form the door side mounting part 3 (see FIG. 6). The door plate 34 is mounted on the door 2 via a door mounting surface 34*e*.

Next description is made, with reference to FIGS. 11(*a*) to 11(*e*), about the connecting method of the mounting member 30 and the door side mounting part 33. FIG. 11(*a*) illustrates the mounting member 30 and the door side mounting part 33 which are not yet connected. The mounting member 30 has a stepped pin 32 formed on. The door side mounting part 33 is arranged such that the lever 36 is biased to the left by the mounting spring 35.

FIG. 11(*b*) illustrates a door plate hook 34*d* and lever hook 36*c* fit in the right-side stepped pin 32 of the mounting member 30. As illustrated in FIG. 10, a lever approach part 36*b* of the lever hook 36*c* on the front side is longer than an approach part 34*b* of the door plate hook 34*d*. With this structure, even when the lever 36 is biased by the mounting spring 35, the approach part 34*b* of the door plate hook 34*d* is prevented from being narrowed by the lever approach part 36*b*. Therefore, easy fitting is allowed.

FIG. 11(*c*) illustrates the door side mounting part 33 which is brought close to the mounting member 30 after the door plate hook 34*d* and the lever hook 36*c* are fit on the right-side stepped pin 32 of the mounting member 30. The left-side stepped pin 32 of the mounting member 30 is in contact with a tapered part 34*c* of the door plate 34.

Further, FIG. 11(*d*) illustrates the door side mounting part 33 which is pressed against the mounting member 30. As the lever 36 is slid to the right against the spring force of the mounting spring 35, the left-side stepped pin 32 of the mounting member 30 can be fit in the lever lock 36*d* thereby to be able to connect the mounting member 30 to the door side mounting part 33.

FIG. 11(*e*) illustrates the mounting member 30 and the door side mounting part 33 connected to each other. When the left-side stepped pin 32 of the mounting member 30 is fit in the lever lock 36*d*, the lever lock 36*d* is slid to the left by the spring force of the mounting spring 35 so that the left-side stepped pin 32 of the mounting member 30 is prevented from being disengaged from the lever lock 36*d*.

As described above, after the door plate hook 34*d* and the lever hook 36*c* of the upper side of the door side mounting part 33 mounted on the door 2 are fit on the stepped pins 32 of the mounting member 30, the door 2 can be easily connected to the mounting member 30 only by rotating the door 2 with use of the upper-side stepped pin 32 and there is no need to get up the door 2.

When the door 2 is removed from the mounting member 30, the lever 36 is pressed to the right so that the lever 36 and the left-side stepped pin 32 of the mounting member 30 are disengaged. Then, the door 2 is held up while the lever 36 is pressed, the lever 36 is rotated and released from the left-side stepped pin 32 of the mounting member 30 completely (see FIG. 11(*b*)).

Figure 12:
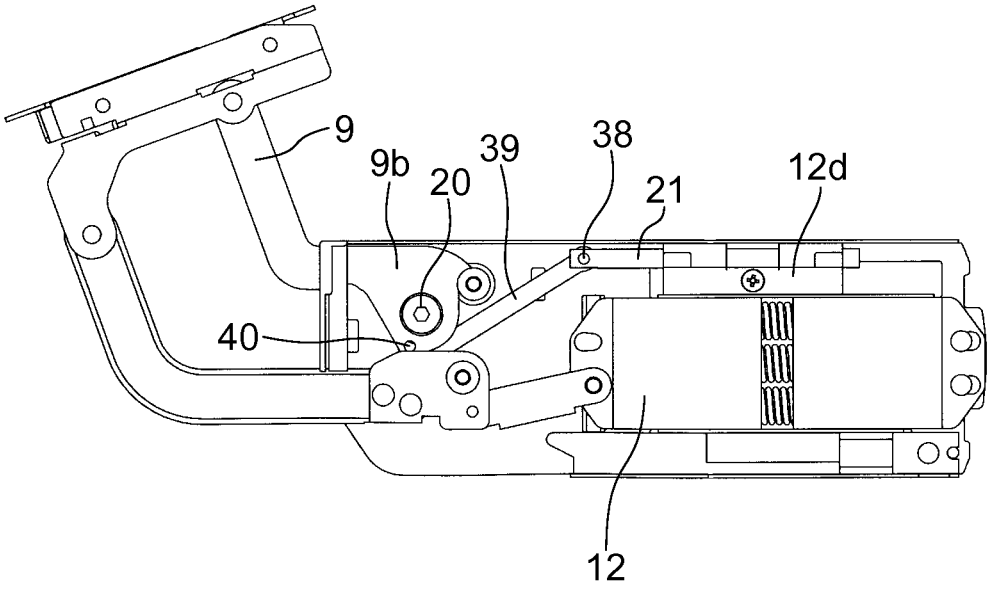
FIG. 12 is a plan view of the door opening and closing device according to a second embodiment of the present invention (the door is open)

Next description is made about a door opening and closing device according to the second embodiment of the present invention. FIG. 12 illustrates the door opening and closing device according to the second embodiment.

In this embodiment, the block 12*d* as a fixed part of the friction damper 22 is a separate member from the runner 12 and fixed to the case 11. The friction bar 21 as a slider of the friction damper 22 is not fixed to the stopper 13 and is slidable relative to the block 12*d*. At the tip end on the auxiliary arm 9 side, an auxiliary axis pin 38 is provided. An end of an auxiliary link arm 39 is connected rotatable to the auxiliary axis pin 38. Besides, around the auxiliary arm axis 20, an auxiliary pivot pin 40 passes through a rotation base 9*b* of the auxiliary arm 9 and the auxiliary link arm 39. The auxiliary link arm 39 is connected rotatable by the auxiliary pivot pin 40. As the auxiliary arm 9 rotates by opening and closing of the door 2, the auxiliary link arm 39 slides the friction bar 21 thereby to produce a damping force.

Figures 13A, 13B, 13C, 13D, 13E, 13F, 13G, 13H:
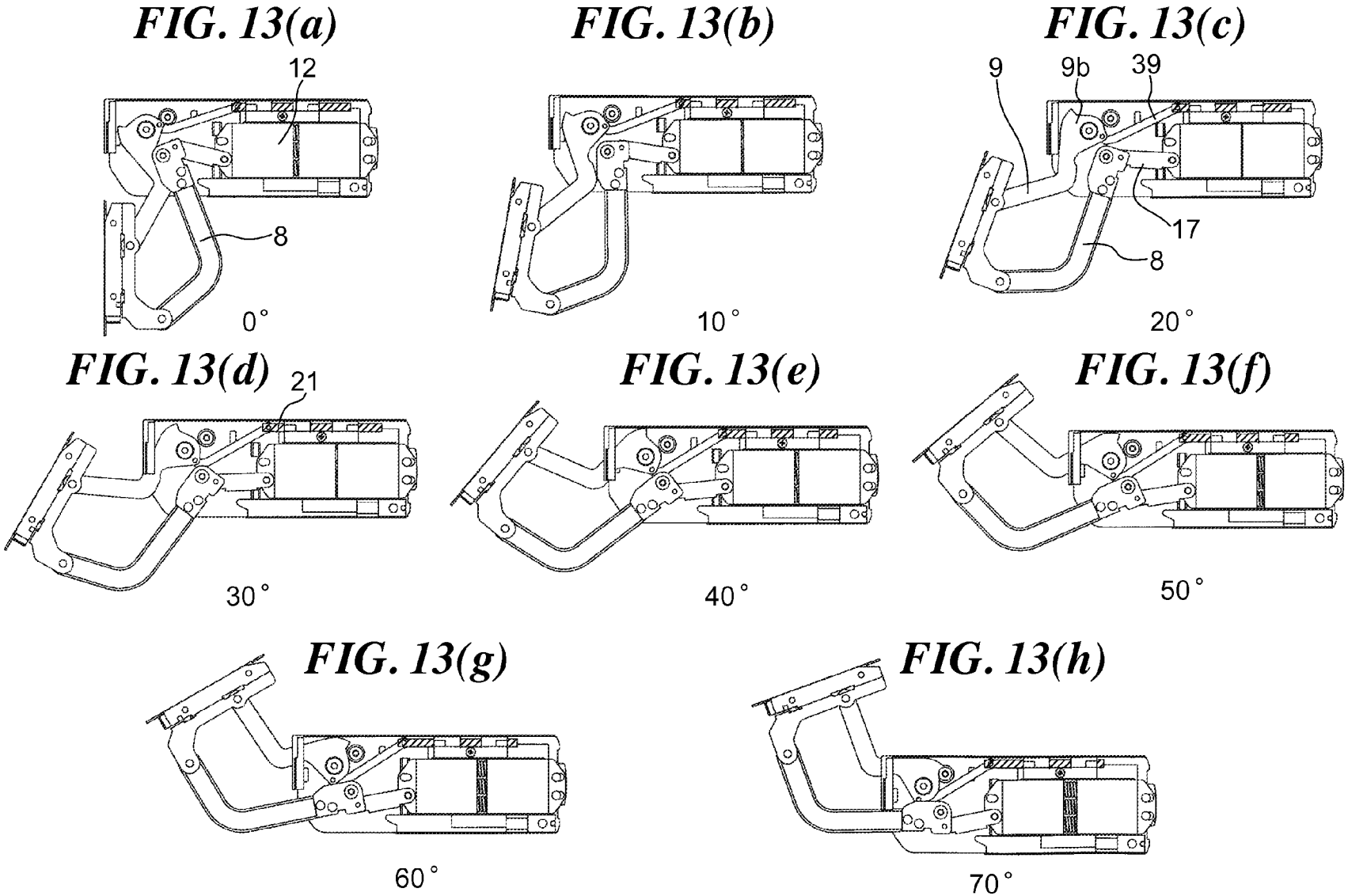
FIGS. 13(*a*) to 13(*h*) are plan views of the door opening and closing device in which the arm rotates by 10 degrees (FIG. 13(*a*) illustrates the door closed, and FIGS. 13(*b*) to 13(*h*) illustrate the arm rotating by 10 degrees.

Next description is made about the relation between rotation of the arm 8 and sliding of the friction bar 21 with reference to FIGS. 13(*a*) to 13(*h*).

FIGS. 13(*a*) to 13(*h*) illustrate the door opening and closing device in which the arm 8 rotates by 10 degrees. FIG. 13(*a*) illustrates the door 2 closed, and the rotation angle of the arm 8 is 0 degree. In FIG. 13(*c*), the rotation angle of the arm 8 is 20 degrees, the friction bar 21 does not slide and there occurs no damping force. In FIG. 13(*d*), the rotation angle of the arm 8 is 30 degrees, the friction bar 21 starts to slide and a damping force starts to be generated. The following process is the same as that in the first embodiment until the door 2 is the open state of FIG. 13(*h*).

In the second embodiment, sliding of the runner 12 and the friction damper 22 is adjusted by the auxiliary link arm 39 pivoted to the rotation base 9*b* of the auxiliary arm 9 and the link arm 17 pivoted to the rotation base 8*a* of the arm 8. As the friction damper 22 and the runner 12 slide separately by opening and closing of the door 2, it is possible to set the damping force by friction and the biasing force by the compression spring 14 in an appropriate manner.

Figure 14:
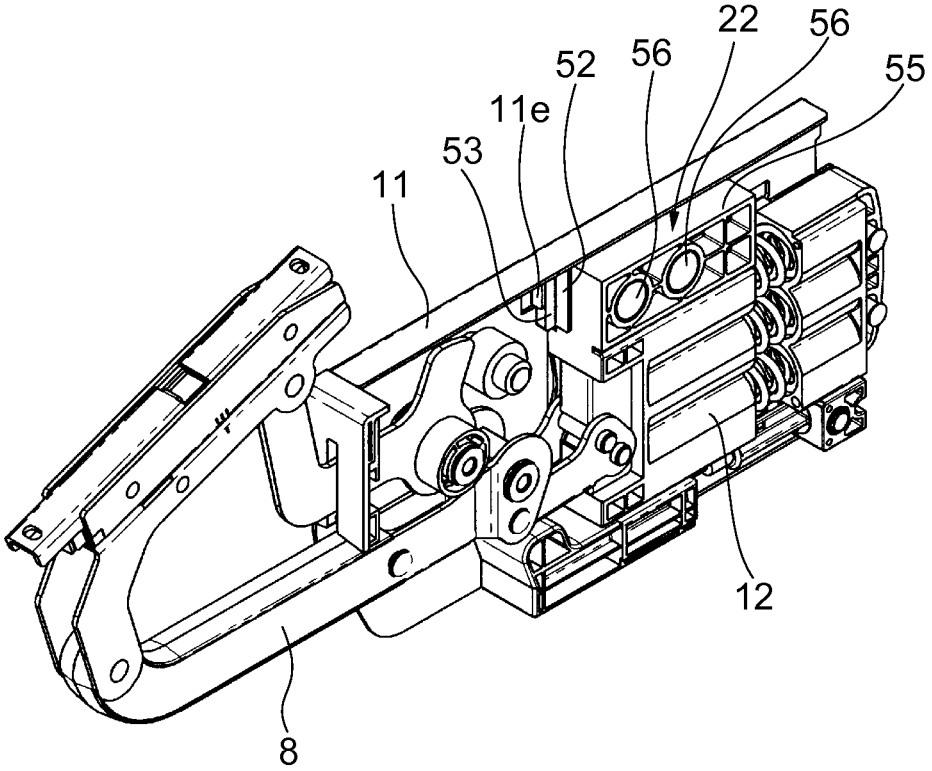
FIG. 14 is a perspective view of the door opening and closing device according to a third embodiment of the present invention.

Next description is made about a door opening and closing device according to the third embodiment of the present invention. FIG. 14 is a perspective view of the door opening and closing device according to the third embodiment.

In the door opening and closing device according to the third embodiment, like the door opening and closing device in the first embodiment, the runner 12 is connected integrally to sliders 51, 52 (see FIG. 16) of the friction damper 22 so that the runner 12 and the sliders of the friction damper 22 can move linearly together. On the runner 12, a housing case 55 of rectangular shape for housing the friction damper 22 is formed integrally by resin molding. The sliders 51 and 52 of the friction damper 22 are connected to this housing case 55. A fixed plate 53 as a fixed part of the friction damper 22 is connected integrally to the case 11.

Figure 15:
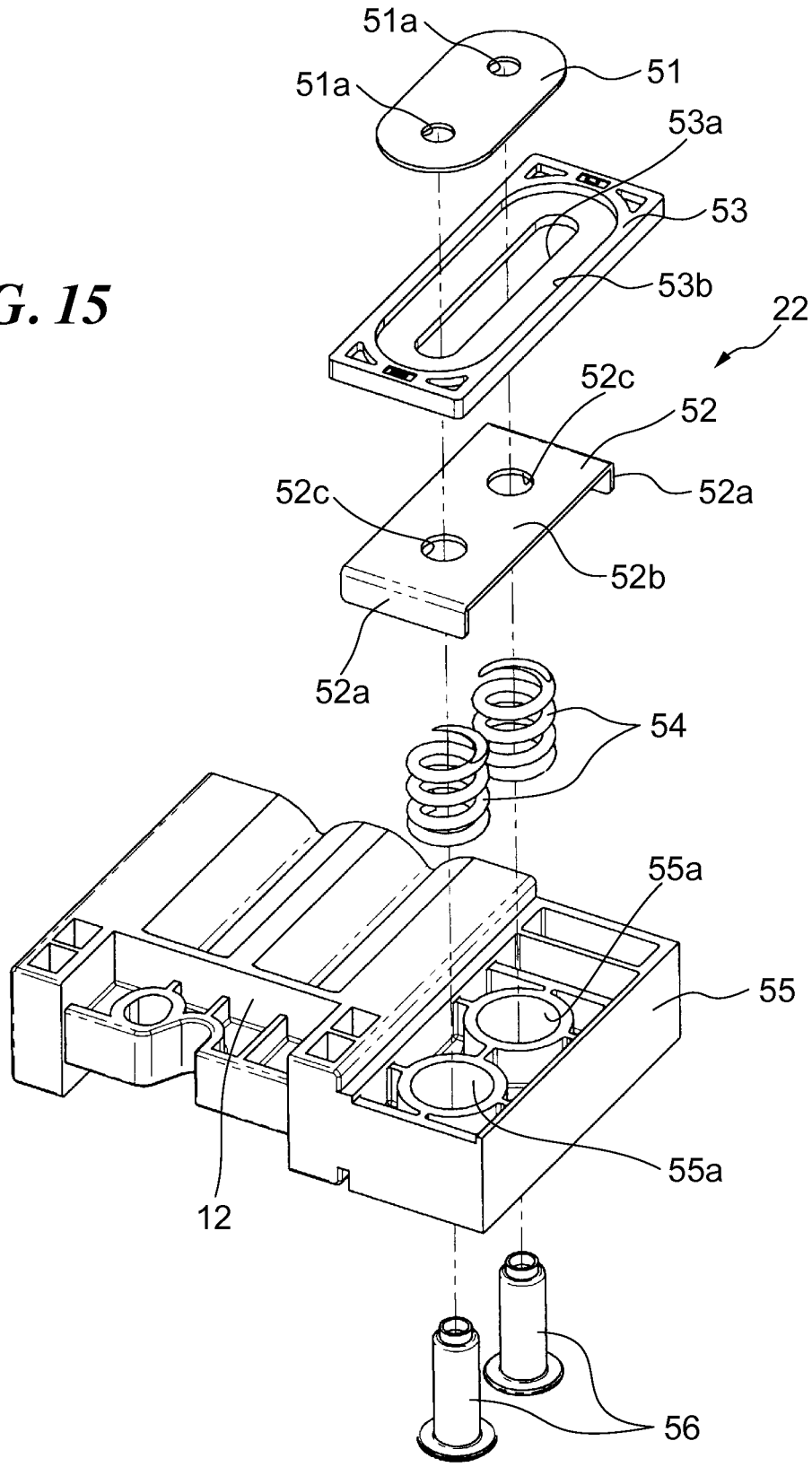
FIG. 15 is an exploded perspective view of a friction damper.

FIG. 15 is an exploded perspective view of the friction damper 22. The friction damper 22 has a fixed plate 53 as a fixed part which is fixed to the case 11 of the door opening and closing device, the sliders 51 and 52 of plate shape in a pair for sandwiching the fixed plate 53 and coil springs 54 as pressing means for pressing the slider 52 toward the fixed plate 53.

The fixed plate 53 has a rectangular shape and has, at the center, a long hole 53*a* extending in the moving direction of the runner 12. Around the long hole 53*a*, a guide groove 53*b* is formed which is elongated in the moving direction of the runner 12. The guide groove 53*b* has a square center part and semicircular ends. A bottom surface (contact part) of the guide groove 53*b* of the fixed plate 53 in contact with the slider 51 is flat and a back surface (contact part) of the fixed plate 53 in contact with the slider 52 is also flat. The fixed plate 53 is, for example, made of resin. The fixed plate 53 is fixed to a recess of the case 11. In the case 11, a bent piece 11*e* (see FIG. 14) is formed for fixing the fixed plate 53.

The slider 51 is fit slidable in the guide groove 53*b* of the fixed plate 53. The slider 51 has a square center part and semicircular ends. In order that the slider 51 is slidable along the guide groove 53*b*, the length of the slider 51 in the moving direction is shorter than the length of the guide groove 53*b* of the fixed plate 53. At the center part of the slider 51, a pair of holes 51*a* is formed for insertion of pins 56. A bottom surface (contact part) of the slider 51 in contact with the guide groove 53*b* is also flat. The slider 51 is, for example, made of metal.

At the opposite side of the fixed plate 53 to the slider 51, the other slider 52 of plate shape is arranged. This slider 52 has a rectangular shape and both ends 52*a* in the moving direction are bent at a right angle. The bent ends 52*a* are fit on the walls of the housing case 55 of the runner 12 (see FIG. 14). A main body 52*b* (contact part) of the slider 52 in contact with the fixed plate 53 is flat. At the center part of the slider 52, a pair of holes 52*c* is formed for insertion of the pins 56. The slider 52 is, for example, made of metal.

Between the slider 52 and the housing case 55, the coil springs 54 are provided for pressing the slider 52 toward the fixed plate 53. The friction force generated between the fixed plate 53 and the slider 52 is adjusted by an elastic force of these coil springs 54. The coil springs 54 press the slider 52 against the fixed plate 53 under a constant pressure even when the fixed plate 53 wears.

In assembling the friction damper 22, first, the coil springs 54 are inserted into cylindrical parts 55*a* of the housing case 55. The slider 52 is placed on the coil springs 54 and the both ends 52*a* of the slider 52 are fit to the walls of the housing case 55. Next, the fixed plate 53 is placed on the slider 52 and the slider 51 is fit in the guide groove 53*b* of the fixed plate 53. The paired pins 56 are inserted into the cylindrical parts 55*a* from the bottom side of the housing case 55 and the pins 56 are made to pass through the holes 51*a* of the slider 51 so that the two sliders 51 and 52 are integral with the housing case 55. Once the friction damper 22 is assembled, the runner 12 is mounted on the case 11. Then, the fixed plate 53 of the friction damper 22 is fixed to the case 11. In this embodiment, as the friction damper 22 is comprised of the plate-shaped sliders 51 and 52 and the fixed plate 53, it is easy to assemble the friction damper 22.

Figure 16A:
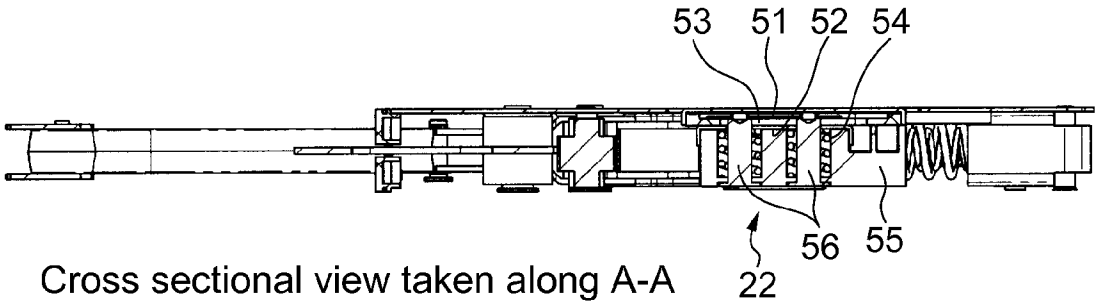
Figure 16B:
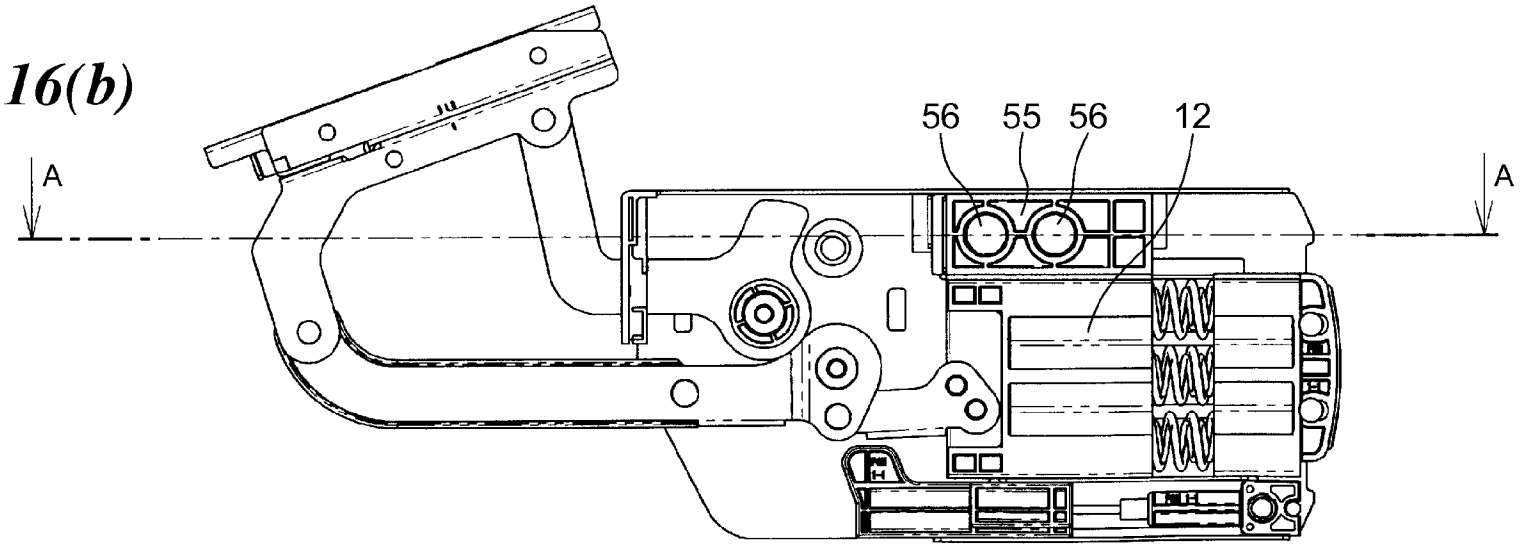

FIGS. 16(*a*) and 16(*b*) are cross sectional views of the door opening and closing device with the friction damper 22 mounted on. The sliders 51 and 52 in a pair for sandwiching the fixed plate 53 are integral with the housing case 55 by the pins 56. The sliders 51 and 52 in a pair move linearly in the moving direction of the runner 12 relative to the fixed plate 53 while sandwiching the fixed plate 53. The force of the slider 52 to press the fixed plate 53 is adjusted by the coil springs 54.

Here, the present invention is not limited to the above-described embodiments and may be embodied in various modified forms without departing from the scope of the present invention. For example, the mechanism for synchronizing rotation of the arm with liner movement of the runner is not limited to the link arm, but may be, for example, a cam mechanism. Or, it may be such a mechanism that a long hole is formed in the runner and the pivot pin of the arm is fit in the long hole of the runner.

In the above-described embodiments, the friction damper operates when the door rotates in the closing direction, as well as when the door rotates in the opening direction. However, the operation of the friction damper may be limited to either of when the door rotates in the closing direction and when the door rotates in the opening direction.

In the above-described embodiments, the arm and auxiliary arm form the four-link mechanism, however, the auxiliary may be omitted.

In the above-described embodiments, the runner is used to apply biasing forces in the opening and closing directions. However, a coil spring connected at one end to the arm may be used to apply biasing forces in the opening and closing directions directly to the arm.

The present specification is based on Japanese Patent Application No. 2010-094715 filed on Apr. 16, 2010, the entire contents of which are expressly incorporated by reference herein.

REFERENCE NUMERALS

1 . . . door mounting member
2 . . . door
7 . . . door opening and closing device
8 . . . arm
8*a* . . . rotation base
11 . . . case
12 . . . runner
12*b* . . . slit
12*c* . . . through hole (hole)
12*d* . . . block (slider, fixed body)
14 . . . compression spring (biasing means)
17 . . . link arm
21 . . . friction bar (slider, fixed body)
22 . . . friction generating means (friction damper)
24 . . . adjustment bolt
26 . . . linear damper

The invention claimed is:

1. A door opening and closing device, comprising:
a case mounted on a door mounting member;
an arm which is provided rotatable on the case and rotates by opening and closing of a door;
a runner that is linearly movable on the case and is biased by biasing means to apply at least one of a biasing force in an opening direction and a biasing force in a closing direction to the arm;
a link arm which has one end connected rotatable to the runner and an opposite end connected rotatable to the arm around a rotation center of the arm; and
a friction damper having a slider which is fixed to the runner so as to move linearly with the runner relative to the case by opening and closing of the door and a fixed part which is fixed to the case to slide the slider, the friction damper being provided for generating friction between the slider and the fixed part.

2. The door opening and closing device of claim 1, wherein
the slider and the fixed part of the friction damper have respective contact parts where the slider and the fixed part are in contact with each other, and
the friction damper further includes a spring that urges one of the contact parts of the slider and the fixed part toward the other in a direction orthogonal to a direction of linear movement of the slider.

3. The door opening and closing device of claim 1, wherein
either one of the slider and the fixed part of the friction damper has a friction bar which is in parallel with a direction of linear movement of the runner, and the other of the slider and the fixed part of the friction damper has a hole for insertion of the friction bar.

4. The door opening and closing device of claim 3, wherein the other of the slider and the fixed part of the friction damper has a slit which is linked to the hole, and an adjustment bolt is used to adjust a width of the slit thereby to adjust a size of the hole for insertion of the friction bar.

5. The door opening and closing device of claim 1, wherein the door opening and closing device further comprises a linear damper for braking rotation of the arm just before the arm rotates up to a fully open position or fully closed position.

6. The door opening and closing device of claim 2, wherein the door opening and closing device further comprises a linear damper for braking rotation of the arm just before the arm rotates up to a fully open position or fully closed position.

7. The door opening and closing device of claim 3, wherein the door opening and closing device further comprises a linear damper for braking rotation of the arm just before the arm rotates up to a fully open position or fully closed position.

8. The door opening and closing device of claim 4, wherein the door opening and closing device further comprises a linear damper for braking rotation of the arm just before the arm rotates up to a fully open position or fully closed position.

* * * * *